US005267719A

United States Patent [19]

Keller

[11] Patent Number: 5,267,719

[45] Date of Patent: Dec. 7, 1993

[54] PICTURE FRAME WIRE HANGER

[76] Inventor: Theodore F. Keller, 2416 Yorktown #379, Houston, Tex. 77056

[21] Appl. No.: 970,066

[22] Filed: Nov. 2, 1992

[51] Int. Cl.[5] ..... A47G 1/16

[52] U.S. Cl. ..... 248/493; 248/475.1

[58] Field of Search ..... 248/489, 493, 494, 497, 248/498, 547, 475.1; 40/152.1, 153

[56] References Cited

U.S. PATENT DOCUMENTS

| | | | |
|---|---|---|---|
| 1,025,964 | 5/1912 | Costuma | 248/493 |
| 1,651,392 | 12/1927 | Honigbaum | 248/489 X |
| 2,137,837 | 11/1938 | Freudenberger | 248/493 |
| 2,383,658 | 8/1945 | Larson | 248/497 |
| 3,226,065 | 12/1965 | Smith | 248/493 |
| 3,966,157 | 6/1976 | Corral | 248/493 |
| 4,613,108 | 9/1986 | Sundstrom | 248/497 |

FOREIGN PATENT DOCUMENTS

| | | | |
|---|---|---|---|
| 51315 | 7/1919 | Sweden | 248/489 |
| 188468 | 11/1922 | United Kingdom | 248/489 |

*Primary Examiner*—J. Franklin Foss

*Attorney, Agent, or Firm*—Michael P. Breston

[57] ABSTRACT

The hanger for hanging an object, such as a picture frame, or the like, that carries a laterally-extending flexible wire, has a lower body portion, provided with longitudinal slits forming prongs for snubbing the wire within the prongs, and an upper body portion having an opening for accepting a nail therethrough, or a peg for securing the hanger to an upright surface. The resilient prongs are made from a springy metal blank having two slits. The prongs snuggly receive the wire between the lower ends of the prongs to provide a sufficient resilient wedging and snubbing action on the wire by the prongs.

6 Claims, 1 Drawing Sheet

PICTURE FRAME WIRE HANGER

BACKGROUND OF THE INVENTION

1. Field of the invention

This invention generally relates to hangers for wire supported objects such as picture frames, mirrors, diplomas and the like, which are to be mounted on a vertical surface or wall.

2. Prior Art Statement

The most common picture frame hanger is made of a metal piece which has a single hook-shaped lower portion for holding the picture frame wire, and a single hole in its upper portion through which a nail is driven at an angle into the wall.

A hanger made from a metal blank having such a bent out hook to support the wire, and a bumped out V-shaped portion forming a nail hole, is shown in U.S. Pat. No. 2,454,813 issued to Larson.

It has also been proposed, in U.S. Pat. No. 5,069,412 issued to Jacob, that a single hanger on a wider body have multiple stamped out wire support hooks and multiple nail holes.

However, by the nature of their construction, these single or multiple wire support hooks allow the wire to easily shift on the hook, thus requiring frequent level adjustments of the hung picture frame in response to vibration or earth shifts in and around the premises.

This shifting problem is described in U.S. Pat. No. 406,603 issued to Brinkerhoff. His hanger is formed of a metal stamping having a pair of upward bent out hooks, a lower downward bent center hook, or a lower center projection to support or guide the picture frame wire. His hangers are intended to make it more difficult for the picture frame wires to shift on the hooks and hence for the picture frames to rotate relative to their fastening nails. But to use his hanger requires bending and twisting the picture frame wire around the three hooks, or the pair of hooks and the center projection, within the inevitably confined space between the back of the picture frame and the upright supporting wall, which is a very difficult task to effectuate for most users.

It is an object of the present invention to provide a simple, economical hanger for suspending a picture frame or the like which is easy to use and which resiliently snubs the picture frame wire and maintains it in its initially adjusted position for keeping the picture frame level on its supporting wall.

SUMMARY OF THE INVENTION

The device for hanging an object, such as a picture frame or the like, that carries a laterally-extending flexible wire from an upright surface, comprises a hanger having a lower body portion provided with snubbing means having longitudinal slits forming prongs for snubbing the wire within the prongs, and an upper body portion having anchor means for anchoring the hanger to the upright surface. In a simplified embodiment, the anchor means can form an opening for accepting a nail therethrough, or a peg for securing the hanger to the upright surface.

In a preferred embodiment, the resilient prongs have corrugations for snubbing the wire within the prongs by wedging and snubbing the wire, and the prongs are made from a springy metal blank having two slits. The prongs have curved upper ends for snuggly receiving the wire between the lower ends of the prongs to provide a sufficient resilient wedging and snubbing action on the wire by the prongs. The lower body portion additionally includes fastening means for securing it to the upright surface.

DESCRIPTION OF THE PREFERRED EMBODIMENTS

Figure 1:
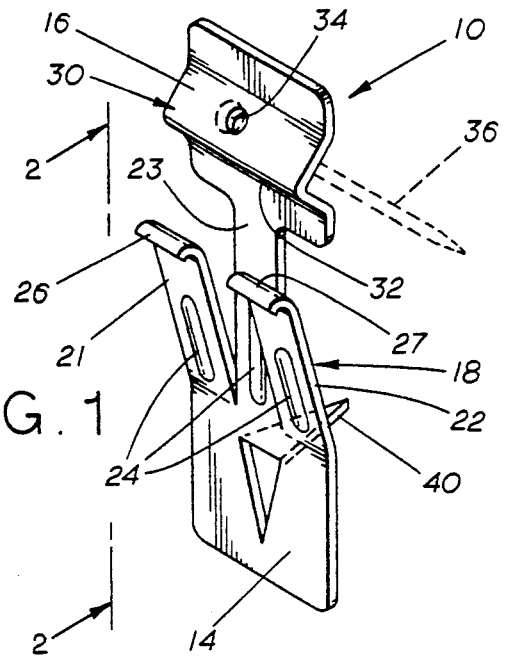
FIG. 1 is an elevational perspective view of the hanger.
Figure 2:
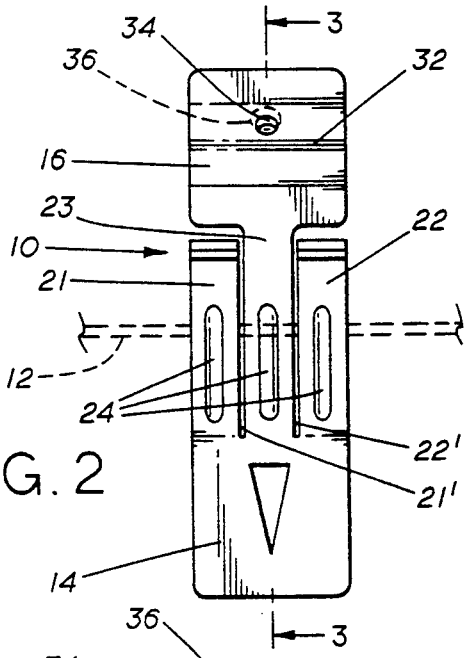
FIG. 2 is a front view of the hanger taken on line 2–2 of FIG.1.
Figure 3:
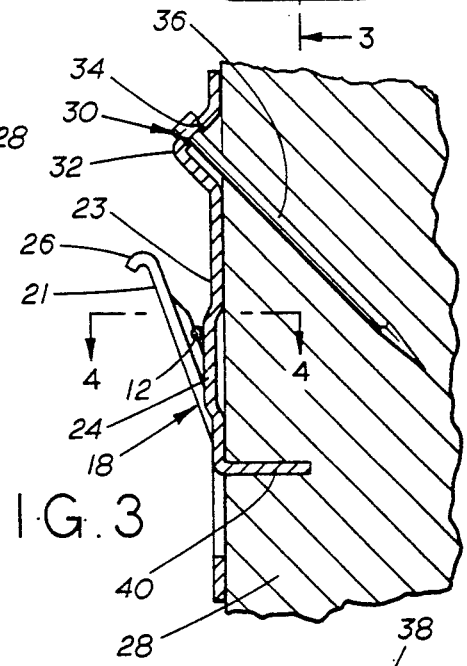
FIG. 3 is a partly sectional view of the hanger taken on line 3—3 of FIG.2.

The hanger device 10 (FIGS. 1–3) of this invention is designed to hang a picture frame (not shown) or the like that carries a laterally-extending flexible wire whose intermediate portion 12 is supported by the hanger.

The hanger 10 is preferably stamped of a blank made from a flat springy metal, or like material, which comprises a lower body snubbing portion 14 and an upper anchoring body portion 16. The lower body portion 14 comprises wire snubbing means 18 such as a pair of laterally-spaced outer tines or prongs 21,22 formed by two slits 21',22' having therebetween a center prong 23 forming a bridge between lower body portion 14 and upper body portion 16. The prongs 21–23 have spring-like characteristics for suspending wire 12.

Preferably, the prongs 21–23 are stamped with longitudinal semi-cylindrical or V-shaped corrugations 24 (FIG. 4) similar to the corrugations on the prongs of the concrete paper form clip shown in my U.S. Pat. No. 2,296,352. Rigidity and strength are imparted to the prongs by the longitudinal corrugations 24 which serve to increase the snubbing action by the prongs 21–23 on the wire.

Figure 4:
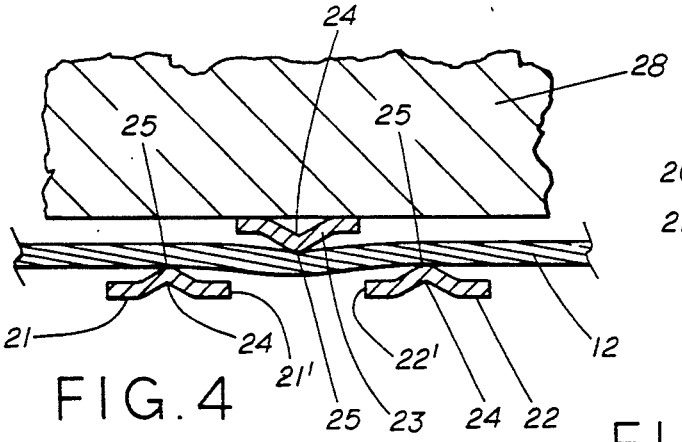
FIG. 4 is a partly sectional view of the hanger taken on line 4–4 of FIG.3.

The ridges 25 of the convex corrugations 24 on the outer prongs 21–22 and the convex corrugation 24 on the center prong 23 are on the opposite sides of wire 12 (FIG.4).

The free ends of the outer prongs 21,22 are preferably turned downwardly to form convex lips 26 and 27 (FIG. 1) thereby to facilitate the threading of the wire 12 between the outer prongs 21,22 when they are spread forwardly of and away from the center prong 23 and its supporting wall 28.

The upper body portion 16 includes securing or fastening means 30 for mounting the hanger 10 to wall 28.

The fastening means 30 includes a forwardly-projecting ridge 32 in the center of which is an aperture or hole 34 adapted to receive a nail 36 at an acute angle to the upright wall 28 supporting the hanger 10.

Figure 5:
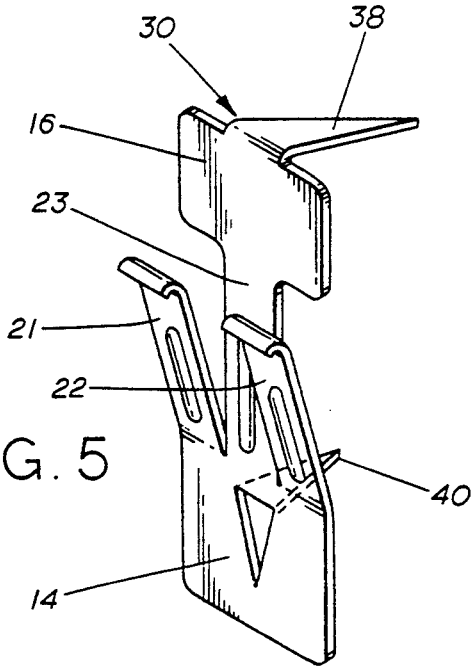
FIG. 5 is an elevational perspective view of the hanger illustrating a modified form of the invention.

While nails are usually utilized to suspend picture frame hangers on a wall, the securing means 30 can be a stamped out triangular peg 38 (FIG. 5) projecting rearwardly and downwardly for penetration into wall 28.

For additional security, the lower body portion 14 is extended downwardly to provide a stamped out peg 40 projecting rearwardly for penetration into wall 28 to prevent the hanger 10 from pivoting about the nail 36.

Figure 6:
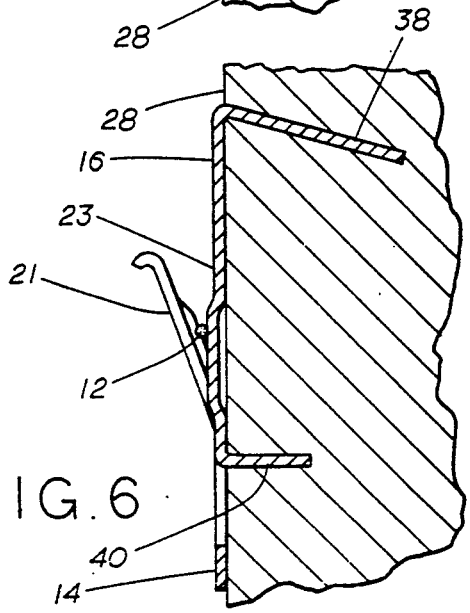
FIG. 6 is a side sectional view showing the modified form of the hanger.

In use, the upper peg 38 or the nail 36 is driven into the wall 28 (FIGS. 3,6) as well as the bottom peg 40, if any.

The picture frame wire 12 is then hung in the space between the stationary prong 23 and the forwardly spaced outer prongs 21,22 and the position of the wire is adjusted to bring the frame into a level position.

The weight of the picture frame will pull down wire 12 until the prongs 21,22 exert horizontal bias forces against the portion of wire 12 captured therebetween, which forces are directed toward center prong 23.

The lower ends of the resilient prongs 21,22 (FIG. 4) together with the lower end of center prong 23 effectively constitute a multi-point snub suspension of wire 12, thereby effectively maintaining the wire 12 and its frame on wall 28 without relative rotation therebetween.

Such suspension provides for wedging and snubbing by pressing and twisting the portion of wire 12 entrapped between the ridges 25 of the longitudinal corrugations 24 on the prongs 21-23.

Because the lower ends of outer prongs 21,22 (FIG. 4) resiliently press against the intermediate portion of wire 12, the outer prongs 21,22 on one hand, and the center prong 23 on the other hand, exert opposite horizontal bias forces which serve to increase the snubbing action exerted by the prongs on wire 12 and in so doing snubbing the wire to prevent it from sliding through the prongs 21-23 and, consequently, to prevent displacement of the picture frame wire relative to the body of hanger 10.

What I claim is:

1. In a hanger for hanging a picture frame or the like, said frame carrying a laterally-extending flexible wire whose intermediate portion is supported by the hanger from an upright wall, said hanger having an upper anchoring body portion merging with a lower body portion, the improvement wherein:

said lower body portion has a center portion and a pair of longitudinal tines positioned on the lateral and opposite sides of said center portion;

said tines are separated from said center portion by a pair of narrow longitudinal slits so that, in use, said wire becomes captured between the edges of said tines and the opposite edges of said center portion;

said captured wire is positioned between the front face of said center portion and the back faces of said tines, whereby said tines move forwardly of and away from said center portion; and said tines and said center portion exert opposite horizontal forces against said captured wire, and said forces effectively prevent said captured wire from shifting and sliding on the back faces of said tines.

2. The hanger according to claim 1, wherein each tine has throughout its length a substantially rectangular cross section.

3. A hanger made from a flat metal blank for hanging a picture frame or the like, said frame carrying a laterally-extending flexible wire whose intermediate portion is supported by the hanger from an upright wall, said hanger having an upper anchoring body portion merging with a lower body portion, the improvement wherein:

said lower body portion has a center portion and a pair of longitudinal stamped out tines positioned on the lateral and opposite sides of said center portion;

said tines being separated from said center portion by a pair of narrow longitudinal slits;

said center portion and each tine has a longitudinal convex bump, whereby, in use, said wire is captured in the space between said center portion and said tines by pulling down on said captured wire so that said tines move forwardly of and away from said center portion; and the ridges of said bumps on said tines and said ridge on said center portion exert opposite horizontal forces against said captured wire, thereby resiliently bending and pinching said captured wire, between the opposite edges of said tines and said center portion, into an undulatory shape, which effectively prevents said captured wire from shifting and sliding on the back faces of said tines relative to said captured wire's initially adjusted position, thereby maintaining said frame level on its supporting wall.

4. The hanger according to claim 3, wherein each tine has throughout its length a substantially rectangular cross section.

5. A hanger made from a flat metal blank for hanging a picture frame or the like, said frame carrying a laterally-extending flexible wire whose intermediate portion is supported by the hanger from an upright wall, said hanger having an upper anchoring body portion merging with a lower body portion, the improvement wherein:

said lower body portion has a center portion and a pair of longitudinal stamped out tines positioned on the lateral and opposite sides of said center portion;

said tines being separated from said center portion by a pair of narrow longitudinal slits, whereby, in use, said wire is captured in the space between said center portion and said tines by pulling down on said captured wire so that said tines move forwardly of and away from said center portion; and said tines and said center portion exert opposite horizontal forces against said captured wire, thereby resiliently bending and pinching said captured wire, between the opposite edges of said tines and said center portion, into an undulatory shape, which effectively prevents said captured wire from shifting and sliding on the back faces of said tines relative to said captured wire's initially adjusted position, thereby maintaining said frame level on its supporting wall.

6. The hanger according to claim 5, wherein each tine has throughout its length a substantially rectangular cross section.

* * * * *